US010707565B2

(12) United States Patent
Navarro Pérez et al.

(10) Patent No.: US 10,707,565 B2
(45) Date of Patent: Jul. 7, 2020

(54) ANTENNA DEVICE FOR HF AND LF OPERATION

(71) Applicant: PREMO, SA

(72) Inventors: Francisco Ezequiel Navarro Pérez, Bobadilla Estación Antequera (ES); Antonio Rojas Cuevas, Málaga (ES); Sergio Cobos Reyes, Málaga (ES)

(73) Assignee: PREMO, SA, Campanillas (Málaga) (ES)

( * ) Notice: Subject to any disclaimer, the term of this patent is extended or adjusted under 35 U.S.C. 154(b) by 1 day.

(21) Appl. No.: 15/772,366

(22) PCT Filed: Nov. 3, 2016

(86) PCT No.: PCT/EP2016/076530
§ 371 (c)(1),
(2) Date: Apr. 30, 2018

(87) PCT Pub. No.: WO2017/076959
PCT Pub. Date: May 11, 2017

(65) Prior Publication Data

US 2018/0323499 A1 Nov. 8, 2018

(30) Foreign Application Priority Data

Nov. 4, 2015 (EP) ..... 15192945

(51) Int. Cl.
*H01Q 1/32* (2006.01)
*H01Q 1/22* (2006.01)
(Continued)

(52) U.S. Cl.
CPC ..... *H01Q 1/3241* (2013.01); *H01Q 1/2216* (2013.01); *H01Q 1/523* (2013.01);
(Continued)

(58) Field of Classification Search
CPC .... H01Q 1/2216; H01Q 1/3241; H01Q 1/523; H01Q 7/06; H01Q 7/08; H01Q 21/30; H01Q 21/24; H01Q 21/28
See application file for complete search history.

(56) References Cited

U.S. PATENT DOCUMENTS 7,755,558 B2 * 7/2010 Ueda ..... H01Q 21/24 343/728
8,451,184 B2 * 5/2013 Murakami ..... H01Q 1/3241 343/788
(Continued)

FOREIGN PATENT DOCUMENTS

EP 3493325 A1 * 6/2019 ..... H01Q 1/2216
JP 2013165368 8/2013
(Continued)

OTHER PUBLICATIONS

International search report and written opinion dated Mar. 24, 2017 for PCT/EP2016/076530.
(Continued)

*Primary Examiner* — Ab Salam Alkassim, Jr.
(74) *Attorney, Agent, or Firm* — Silvia Salvadori

(57) ABSTRACT

The antenna comprises a magnetic core (2), three windings (31, 32, 33) wound around the magnetic core (2) and an electrically insulated base (1) on which the magnetic core (2) wound with these windings (31,32,33) is arranged. The insulated base (1) includes metallic tabs (121 . . . 128) electrically connected to said windings (31, 32, 33) and the base (1) has a bottom surface with electrically conductive plates (131 . . . 138) with connection to the metallic tabs (121 . . . 128) and providing a layout for a SMT mounting, The antenna comprises an electrically insulated cap (4), having an upper surface (4U) including a metallized surface high frequency coil (42) working as a HF antenna and a side surface (4S), two ends (411, 412) of the coil (42) being
(Continued)

arranged on the side surface (4S) for connection to the metallic tabs (121 . . . 128) of the electrically insulated base (1).

10 Claims, 5 Drawing Sheets

(51) Int. Cl.

| | |
|---|---|
| ***H01Q 21/28*** | (2006.01) |
| ***H01Q 21/24*** | (2006.01) |
| ***H01Q 7/06*** | (2006.01) |
| ***H01Q 1/52*** | (2006.01) |
| ***H01Q 7/08*** | (2006.01) |
| ***H01Q 21/30*** | (2006.01) |

(52) U.S. Cl.
CPC ..... *H01Q 7/06* (2013.01); *H01Q 7/08* (2013.01); *H01Q 21/24* (2013.01); *H01Q 21/28* (2013.01); *H01Q 21/30* (2013.01)

(56) References Cited

U.S. PATENT DOCUMENTS

| | | | | |
|---|---|---|---|---|
| 8,907,760 | B2 * | 12/2014 | Nowottnick | G06K 19/07767 340/5.2 |
| 9,647,340 | B2 * | 5/2017 | Yagi | H01Q 7/06 |
| 9,812,772 | B2 * | 11/2017 | Rojas Cuevas | H01Q 1/12 |
| 10,333,204 | B2 * | 6/2019 | Jerez | H01Q 1/2225 |
| 10,403,979 | B2 * | 9/2019 | Ryu | H01Q 21/28 |
| 10,411,767 | B2 * | 9/2019 | Zhao | H01Q 7/06 |
| 10,505,278 | B2 * | 12/2019 | Cobos Reyes | H01Q 7/06 |
| 2003/0222829 | A1 * | 12/2003 | Kitahara | H01Q 1/3241 343/788 |
| 2004/0061660 | A1 * | 4/2004 | Yoshida | G07C 9/00309 343/788 |
| 2005/0083242 | A1 * | 4/2005 | Yagi | H01Q 7/06 343/788 |
| 2006/0152427 | A1 * | 7/2006 | Ueda | H01Q 7/08 343/788 |
| 2007/0195001 | A1 * | 8/2007 | Ueda | H01Q 1/3233 343/788 |
| 2009/0295663 | A1 * | 12/2009 | Sato | H01Q 1/3241 343/788 |
| 2011/0111792 | A1 * | 5/2011 | Griffiths | H01Q 1/22 455/553.1 |
| 2011/0128204 | A1 * | 6/2011 | Murakami | H01Q 1/3241 343/788 |
| 2014/0035793 | A1 * | 2/2014 | Kato | H01Q 1/243 343/867 |
| 2014/0176382 | A1 * | 6/2014 | Nakano | H01Q 1/243 343/788 |
| 2016/0211579 | A1 * | 7/2016 | Rojas Cuevas | H01Q 1/12 |
| 2019/0020379 | A1 * | 1/2019 | Zhao | H04B 5/0031 |

FOREIGN PATENT DOCUMENTS

| | | | | |
|---|---|---|---|---|
| JP | 2013165368 | A * | 8/2013 | |
| JP | 2015080147 | | 4/2015 | |
| JP | 2015080147 | A * | 4/2015 | |
| WO | 2014072075 | | 5/2014 | |
| WO | WO-2014072075 | A1 * | 5/2014 | H01Q 21/30 |
| WO | 2015022000 | | 2/2015 | |
| WO | WO-2015022000 | A1 * | 2/2015 | |
| WO | WO-2017209195 | A1 * | 12/2017 | H01Q 7/06 |

OTHER PUBLICATIONS

European search report and written opinion dated Jun. 24, 2016 for priority application EP 15192945.2.

* cited by examiner

ANTENNA DEVICE FOR HF AND LF OPERATION

RELATED APPLICATIONS

This application is a U.S. national phase application of international application No. PCT/EP2016/076530, filed 3 Nov. 2016, which designates the U.S. and claims priority to European application EP 15192945.2 filed 4 Nov. 2015, the contents of each of which are hereby incorporated by reference as if set forth in their entireties.

TECHNICAL FIELD

The present invention is directed, in general, to inductive antenna devices. In particular, the invention relates to a multipurpose inductive antenna device for HF communication (carrier frequencies between 3-30 MHz) as well as for low-frequency (LF) operation (carrier frequencies between 20-150 KHz).

Nowadays and in particular in the field of PKE (Passive Keyless Entry) systems for the automotive industry several devices need to include in a same package low frequency (20 kHz-150 kHz) antennas (in some cases, three dimensional antennas or three antennas arranged orthogonally over one single magnetic core or over three individual cores) and these devices also need to include HF functionality (preferably Near Field Communications (NFC) functionality at 13.56 MHz.

BACKGROUND OF THE INVENTION

US-B2-U.S. Pat. No. 8,907,760, discloses a remote access system in which a three-dimensional low-frequency (3D-LF) antenna and a HF antenna are used. The 3D-LF antenna includes three coils each oriented relative to X, Y and Z axes that define a Cartesian coordinate system for a three-dimensional space, whereas the HF antenna is oriented along one of the axes of the LF coils, in the same antenna package as the 3D-LF antenna. In this patent, the HF antenna is connected close to one of the LF coils, e.g. by winding the HF antenna around the outside of the LF coils, duly separated, or by placing the HF antenna below and/or above the LF coil (in particular the LF coil located parallel to the Z axes). The 3D-LF antenna is configured to be used in connection with a LF signal of between 3 KHz and 300 KHz while the HF antenna is configured to be used in connection with an HF signal between 3 MHz and 30 MHz.

JP 2015080147 A discloses a dual-band antenna device for a keyless entry system, comprising a single coil antenna wound around a magnetic core and a second planar coil antenna disposed on an insulating substrate, wherein the second planar coil antenna is arranged above the first coil antenna, and wherein the first single coil antenna and the second coil antenna are isolated from each other by a ferromagnetic material sheet. This patent then integrates a RF antenna (310 MHZ for remote opening/closing) of the control of the key in a PKES with an antenna LF for Wake up or RFID. Although the dual-band antenna device of this Japanese patent application can work as a LF and as a HF antenna, unlike the proposed antenna device, it cannot work at a frequency range comprised between 3 and 30 MHz when working as a HF antenna. Moreover, the HF antenna of this dual-band antenna device is not arranged on an electrically insulating replaceable cap, and so not allowing different performances of the HF antenna.

WO2015/022000 A1 discloses an antenna device with several winding wound around a magnetic core and an adaptor arranged over the magnetic core and having an external surface comprising electrically conductive platings following a specific PCB layout and connected to electrically conductive elements coupled to said windings.

An object of the invention is to provide an improved inductive antenna device for both functionalities (HF and LF communications) saving components and physical space. In particular according to the solution of this invention the HF antenna is integrated in an element, a cap, that provides protection of the elements of the LF antenna (upper part and sides) and which can be easily replaced allowing different embodiments of the HF antenna independently of the arrangement of the LF antennas.

DESCRIPTION OF THE INVENTION

Embodiments of the present invention provide an antenna device, comprising as commonly in the field, at least one magnetic core; one or more windings wound around said magnetic core providing a LF antenna adapted to work at a frequency comprised in a range between 20 and 150 kHz, and an electrically insulated base, on which the magnetic core wound with the winding or windings is arranged. The electrically insulated base includes metallic tabs at least part of which are electrically connected to said winding or windings and the electrically insulated base has a bottom surface with electrically conductive plates providing a layout intended for a SMT mounting, wherein at least one of said metallic tabs of the electrically insulated base is connected to at least one of the electrically conductive plates.

Unlike to the known antenna structure, the proposed antenna device further comprises an electrically insulated cap (for example a plastic cap) having an upper surface and a side surface, at least one metallized surface high frequency coil with two ends being arranged on said upper surface wherein the metallized surface high frequency coil works as an antenna and is electrically connected by an extended portion of each of the two ends, arranged on said side surface, to said metallic tabs of the electrically insulated base. The electrically insulated cap is replaceable, thereby allowing different performances of the high frequency coil as an inductive HF antenna adapted to work at a frequency comprised in a range between 3 and 30 MHz, independently of the arrangement of the LF antenna.

For an embodiment, one metallic tab of the electrically insulated base is connected to at least one winding by welding a braided end of said winding to the metallic tab. The electrically insulated base further comprises at least one of said metallic tabs per winding end.

According to an embodiment, the at least one magnetic core is a monolithic magnetic core, the antenna device constituting a monolithic antenna device. Preferably, in this case, the at least one magnetic core is a ferrite magnetic core, which may be formed with a Nickel-Zinc alloy or a Manganese-Zinc alloy and/or amorphous cobalt, among others.

For a preferred embodiment, the LF antenna device comprises three windings wound about three mutually orthogonal axis, each of said windings surrounding the at least one magnetic core, i.e. 3 LF orthogonal antennas for RFID bands (20 KHz to 150 KHz) with three windings, while the HF antenna comprises a spiral (multiple turns) for instance for the NFC 13.56 MHz band In a preferred embodiment the HF antenna is printed by laser deposition on the plastic cap.

The cited cap provides a protection of the wires and connections against impacts, shocks, welding heat and chemicals used in the assembly procedure increasing the reliability of the multipurpose antenna device.

As far reading distance degradation of HF antennas in proximities of metallic surface is well known, an intermediate ferromagnetic material sheet could be optionally located between the cap and the rest of the part to insulate the HF antenna of the cap from the rest of the device including the LF antenna components and to prevent, if needed, the occurrence of eddy currents and in this way to improve the reading distance of the HF antenna (13.56 MHz). Besides this solution make possible to use two different magnetic materials in the same device allowing adjusting the features of each of them in order that the quality factor Q and the sensibility of each of the LF and HF antennas be optimal.

BRIEF DESCRIPTION OF THE DRAWINGS

The previous and other advantages and features will be more fully understood from the following detailed description of one embodiment, with reference to the attached figures, which must be considered in an illustrative and non-limiting manner, in which.

DETAILED DESCRIPTION OF PREFERRED EMBODIMENTS

Figure 1:
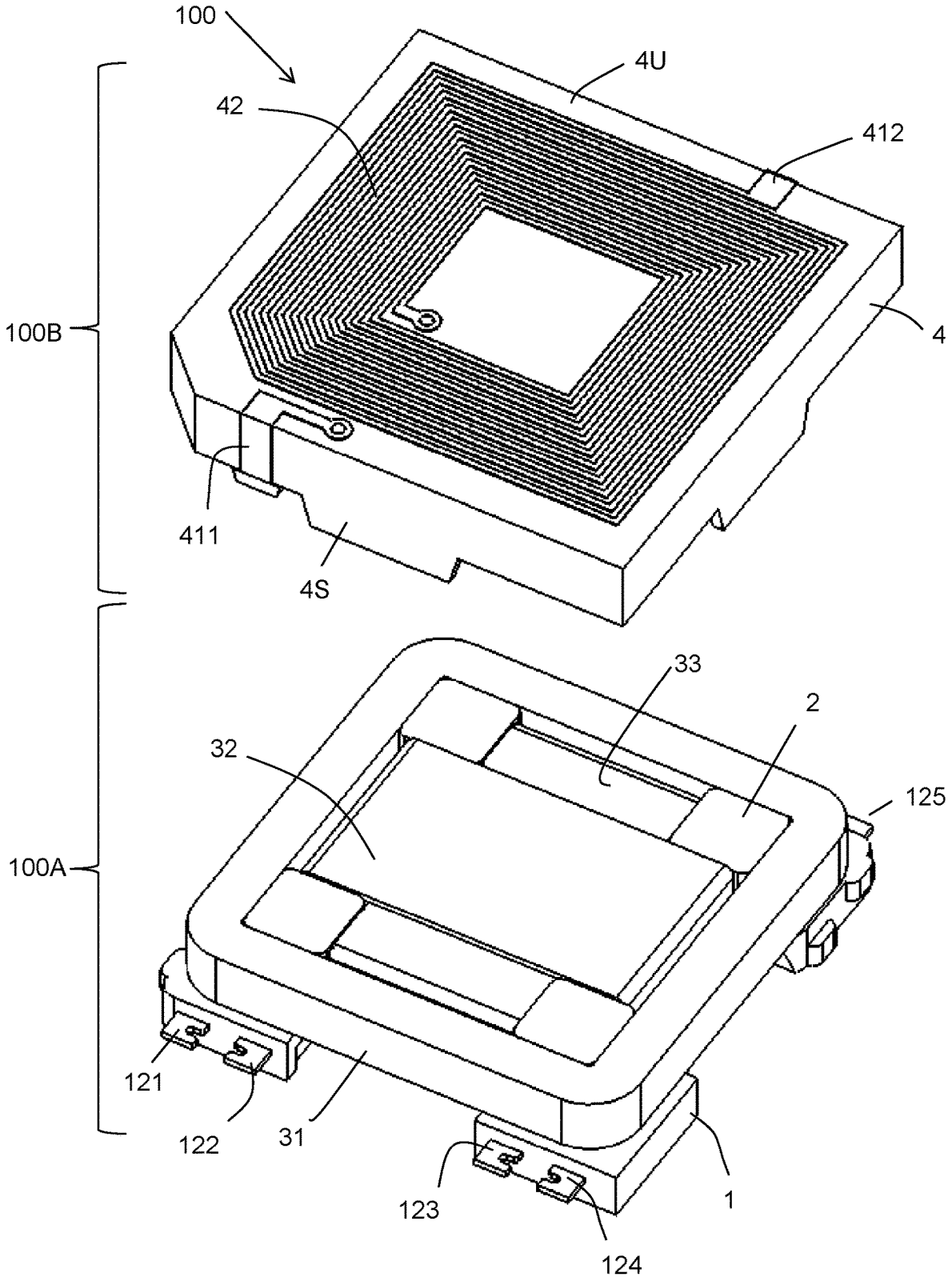
FIG. 1 is a perspective view of the antenna device proposed by present invention, with two separate spaced portions, according to a preferred embodiment.

FIG. 1 shows a preferred embodiment of the proposed antenna device which is capable of working as a radiofrequency antenna in low frequencies range (20 kHz-150 kHz) as well as in HF frequencies (3-30 MHz), preferably NFC frequencies (13.56 MHz).

For said preferred embodiment, the proposed antenna device comprises two portions/parts, namely first 100A and second 100B portions respectively. The first portion 100A of the antenna device comprises according to a structure well known in the field one or more magnetic cores 2, and one or more windings 31, 32, 33 conforming an inductive antenna for radiofrequency applications. Different windings, done in each of the three Cartesians axis allow the antenna device operating as a three-dimensional antenna (working in the three axis of space). In particular, as may be seen in FIG. 1, in the preferred embodiment, the antenna device includes three windings 31, 32, 33 wound over the magnetic core 2, orthogonally, according to the three axis of the space, allowing the proposed antenna device working three-dimensionally. Therefore, regardless of the magnetic field direction produced by an emitter system, the antenna device is able to pick the energy up and allow the communication with the emitter system.

Figure 5:
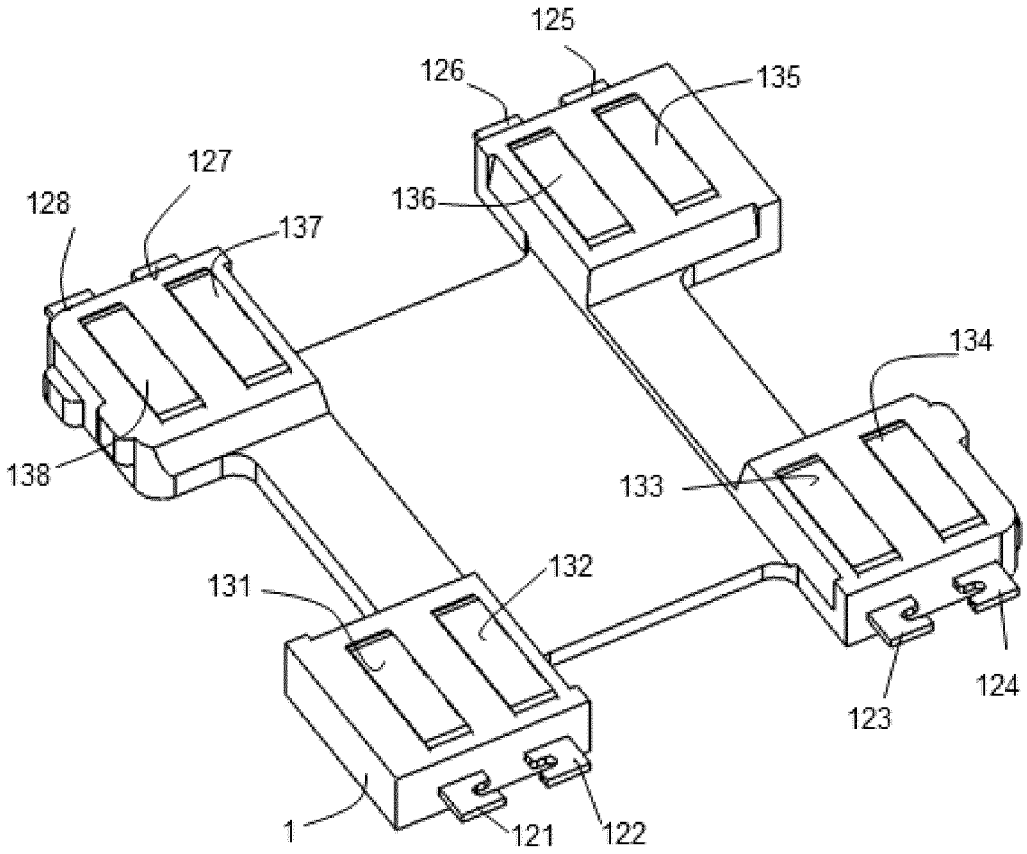
FIG. 5 shows, by means of a perspective view, the electrically conductive metallic plates of the bottom of the electrically insulated base, providing a layout for a SMT mounting.

In addition, the first portion 100A of the antenna device also has an electrically insulated base 1 on which the magnetic core 2 is fixed (through some mechanical procedure, such as an adhesive joint). The mentioned electrically insulated base 1 includes metallic tabs 121 . . . 128 for the connection thereof with one or more of said three windings 31, 32, 33 and has a lower surface, or bottom side, including electrically conductive plates/plates 131 . . . 138 (see FIG. 5) to which said metallic tabs 121 . . . 128 are electrically connected. Electrically conductive plates/plates 131 . . . 138 allow the mounting of the antenna in a standard SMT process.

The connections of different edges of the three windings 31, 32, 33 are made through some soldering method (e.g. solder tip, thermal compression, and conductive adhesive, among others). Besides, the metallic tabs 121 . . . 128 are electrically connected with the electrically conductive plates/plates 131 . . . 138 allowing the use of the antenna device in standard SMT assembly lines.

The second portion 100B of the antenna device comprises an electrically insulated cap 4 that provides a mechanical protection of the first portion 100A that covers. The electrically insulated cap 4 preferably is fixed mechanically (e.g. by using some adhesive joint) over the magnetic core(s) 2 and the three windings 31, 32, 33, after the connection of the LF windings 31, 32, 33 to the metallic tabs 121 . . . 128 of the electrically insulated base 1 being completed.

According to this invention the electrically insulated cap 4 characteristically includes in an upper surface thereof 4U, a metallized surface high frequency coil 42 (i.e. made with metallized tracks), providing a high frequency antenna, preferably a NFC antenna working at a frequency of 13.56 MHz, with ends 411, 412 stretched out by some extended portions (see FIGS. 1 and 2) over lateral sides 4S of the electrically insulated cap 4. Furthermore the metallized surface high frequency coil 42 (that may be constructed to have different number of coils depending on the desired HF carrier frequency needed) is electrically connected (trough some soldering method (e.g. solder tip, thermal compression, and conductive adhesive, among others) by each one of its ends 411, 412 to one or more of said metallic tabs 121 . . . 128 of the electrically insulated base 1. It should be noted that in alternatives embodiments of present invention, in this case not illustrated, more than one metallized surface high frequency coil could be included in the insulated cap 4.

In this way, the antenna device consist of metallic tabs 131 . . . 138 at the bottom of the electrically insulated base 1 with a specific layout that allow the antenna device (over soldering of the antenna device to a PCB for instance by a SMT procedure) to connect electrically with the different LF windings 31, 32, 33 (20 kHz, 134 kHz, 150 kHz) and also to the HF antenna 42 (preferably a NFC antenna working at 13.56 MHz) of the electrically insulated cap 4.

Figure 6:
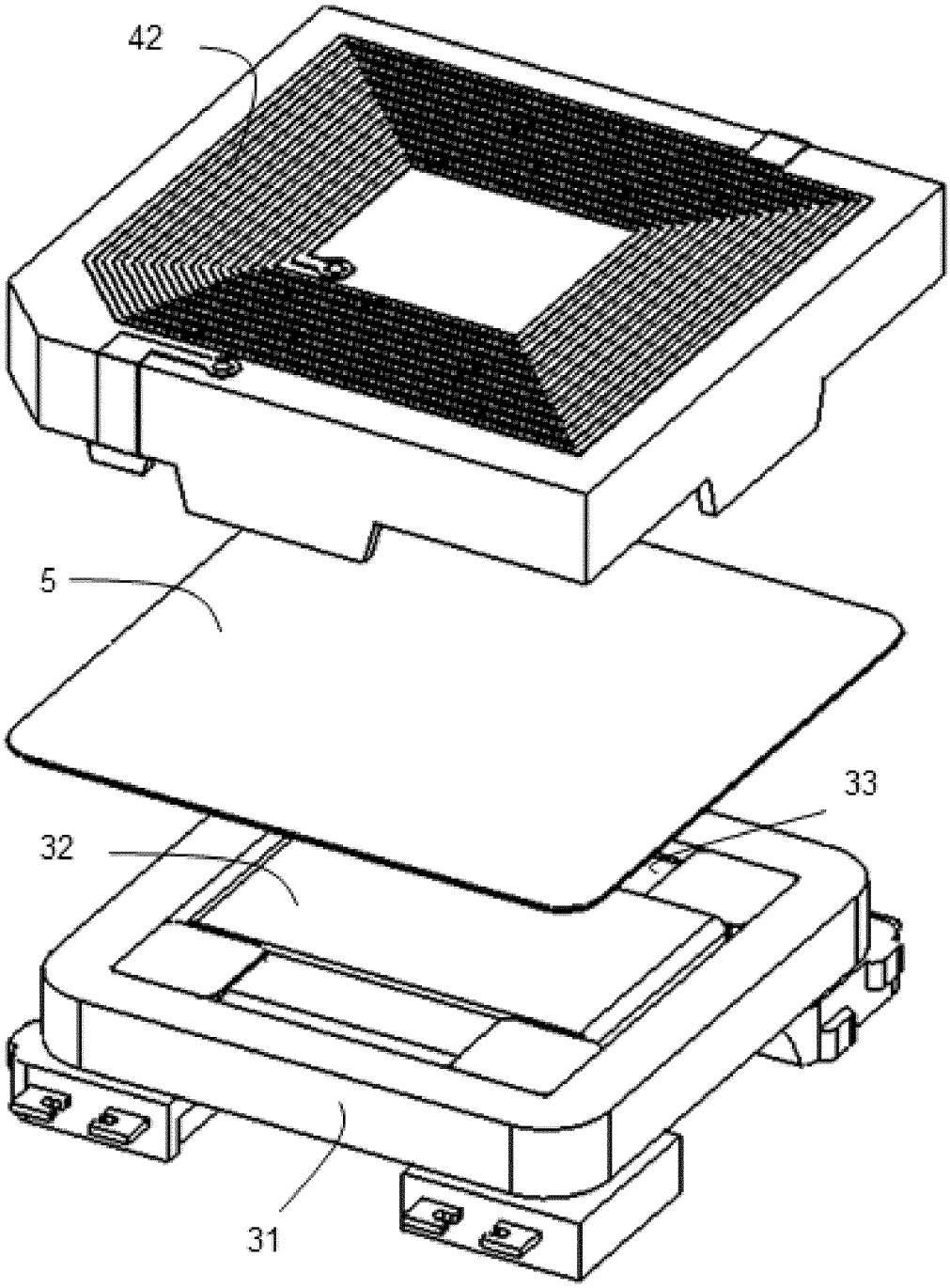
FIG. 6 shows an optional intermediate ferromagnetic sheet provided to insulate, if needed, the HF antenna of the cap from the rest of the device.

FIG. 6 also shows the optional intermediate ferromagnetic sheet 5 to insulate HF antenna 4U of the cap 4 from the rest of the device 100A providing a magnetic decoupling and allowing the use of different magnetic materials in the same device.

Relative permeability of this ferromagnetic sheet 5 would be typically from 100 to 200 (for a HF antenna 42 working for example at 13.56 MHz) and thickness of this sheet would be typically from 0.1 mm to 0.3 mm.

Figure 2:
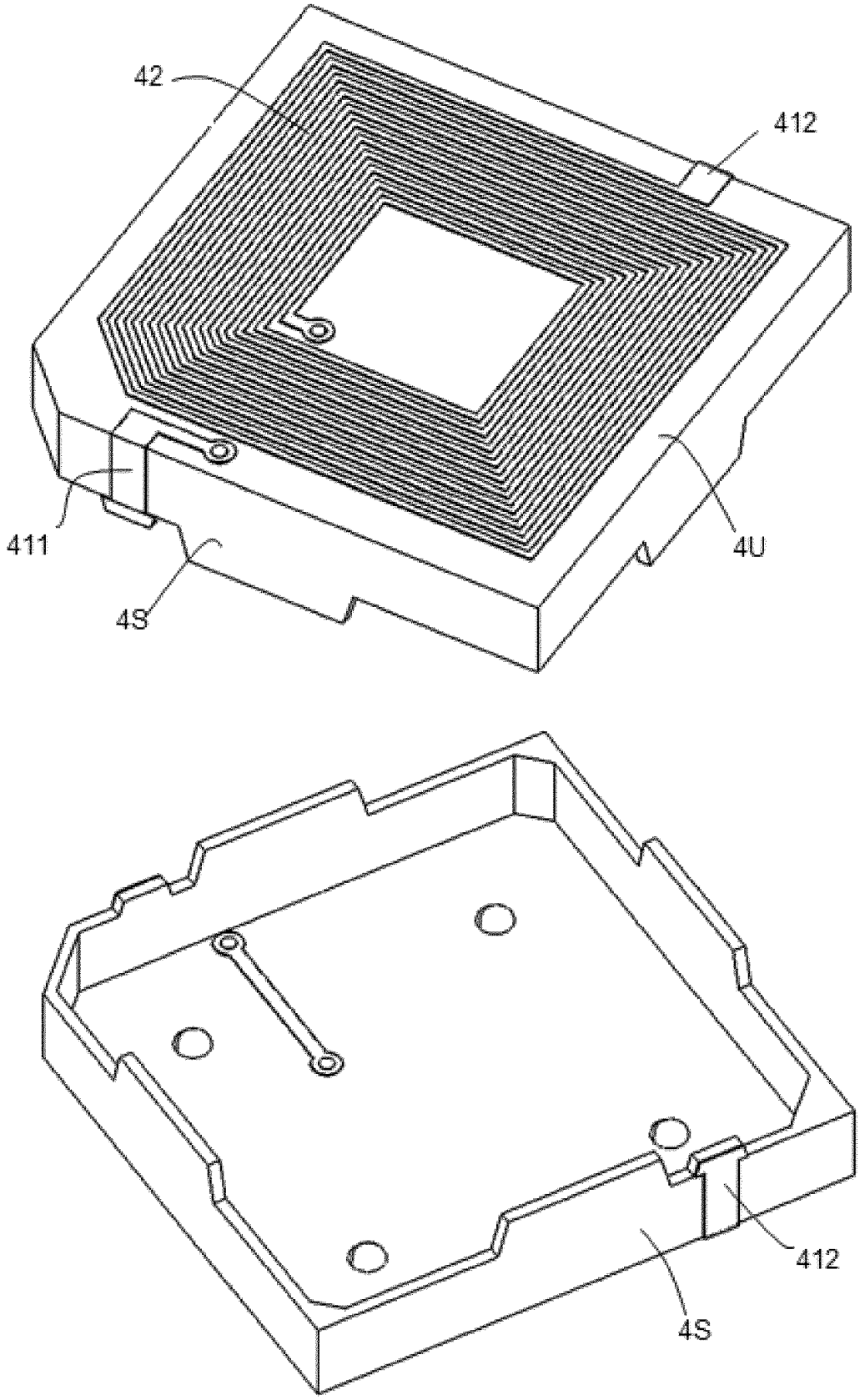
FIG. 2 shows, by means of a perspective view, the electrically insulating cap of the antenna device, provided with a metallized surface high frequency coil, seen from above and inwardly, for an embodiment.

FIG. 2 shows the insulated cap 4 seen from above with upper surface 4U (top part of FIG. 2) bearing the metallized surface high frequency coil 42 and side surface 4S with extended portion 411 of a first end of said metallized surface high frequency coil 42, and seen inwardly showing side surface 4S with the other extended portion 412 of second end of the metallized surface high frequency coil 42.

Figure 3:
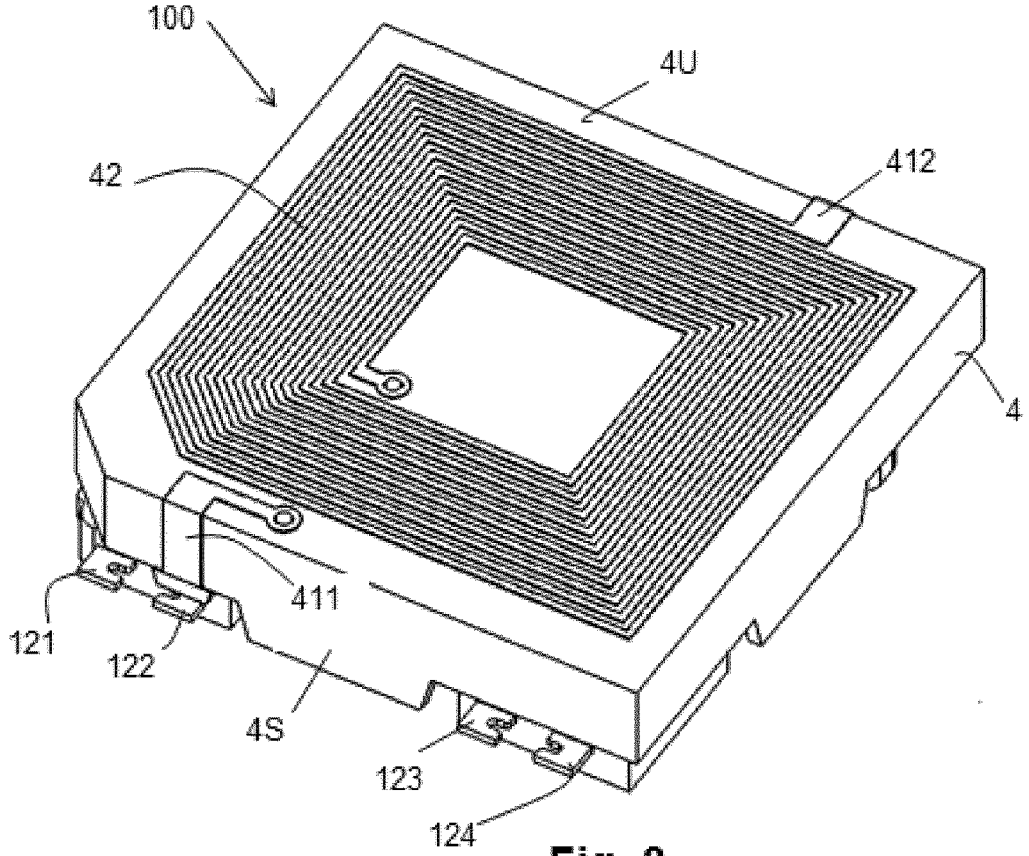
FIG. 3 shows, by means of another perspective view, the proposed antenna device, in this case with the two portions thereof being assembled.

FIG. 3 illustrates another view of the proposed antenna device in which the two portions thereof are assembled showing the electrical connection between extended portion 411 of one end of metallized surface high frequency coil 42 and metallic tab 122 of the electrically insulated base 4.

Figure 4:
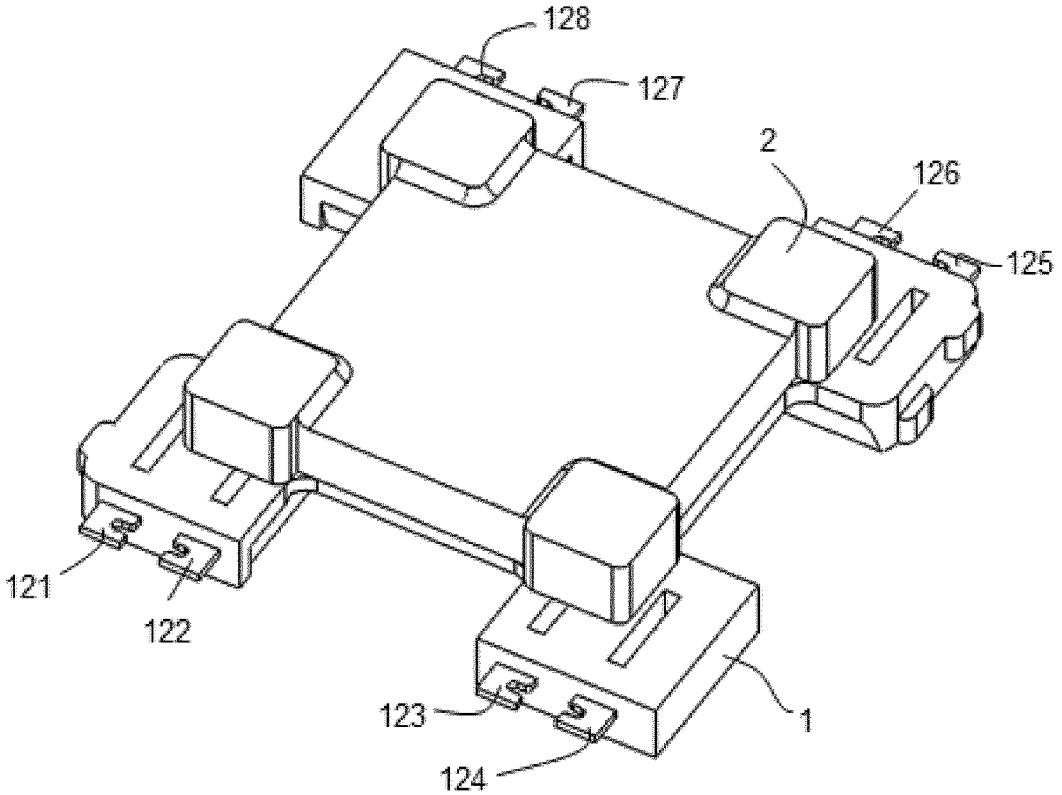
FIG. 4 is a perspective view of the electrically insulated base of the antenna device of the invention, on which the magnetic core is attached, for an embodiment.

FIG. 4 illustrates the electrically insulating base 1 of the antenna device, showing in detail the magnetic core 2 and also the metallic tabs 121 . . . 128 for the connection with the one or more windings 31, 32, 33, the metallic tabs 121 . . . 128 being in turn electrically connected to the electrically conductive plates 131 . . . 138.

As for the materials used for building the antenna device, the magnetic core is made as a monolithic magnetic core, formed for example of a ferrite magnetic core such as Nickel-Zinc alloy, Manganese-Zinc alloy, and/or amorphous Cobalt.

The windings are, preferably, of a diameter of between 0.01 mm and 1 mm and can be made with cables enamelled with polyurethane and (or polyamide with a heat index of about 150° C. or higher).

A person skilled in the art could introduce changes and modifications in the embodiments described without departing from the scope of the invention as it defined in the attached claims.

The invention claimed is:

1. An antenna device, comprising:

at least one magnetic core;

at least one winding wound around said at least one magnetic core providing a LF antenna adapted to work at a frequency comprised in a range between 20 to 150 kHz; and an electrically insulated base, on which said at least one magnetic core wound with said at least one winding is arranged, said electrically insulated base including metallic tabs at least part of which are electrically connected to said at least one winding and the electrically insulated base having a bottom surface with electrically conductive plates providing a layout for a SMT mounting, wherein at least one of said metallic tabs is connected to at least one of said electrically conductive plates, wherein the antenna device further comprises an electrically insulated cap, arranged over and covering said at least one magnetic core, the insulated cap having an upper surface and a side surface, and at least one metallized surface high frequency coil with two ends being arranged on said upper surface of the insulated cap, said metallized surface high frequency coil working as an antenna and being electrically connected by an extended portion of each of said ends, arranged on said side surface of the electrically insulated cap to at least one of said metallic tabs of the electrically insulated base, wherein the electrically insulated cap is replaceable and it is mechanically fixed over the magnetic core and over the at least one winding, thereby allowing different performances of the high frequency coil as an inductive HF antenna adapted to work at a frequency comprised in a range between 3 and 30 MHz, independently of the arrangement of said LF antenna.

2. The antenna device of claim 1, wherein said at least one metallic tab projects outwardly from at least one side of said electrically insulated base making electrical contact with the extended portions of the ends of the metallized surface high frequency coil.

3. The antenna device of claim 2, wherein said at least one metallic tab is connected to the at least one winding by welding a braided end of the winding to the metallic tab.

4. The antenna device of claim 1, wherein said at least one magnetic core is a monolithic magnetic core, the antenna device constituting a monolithic antenna device.

5. The antenna device of claim 4, wherein said at least one magnetic core is a ferrite magnetic core.

6. The antenna device of claim 5, wherein said ferrite magnetic core is formed with a Nickel-Zinc alloy, a Manganese-Zinc alloy or an amorphous cobalt.

7. The antenna device of claim 1, comprising three windings wound about three mutually orthogonal axes, where each of said windings surrounds said at least one magnetic core.

8. The antenna device of claim 1, wherein the inductive HF antenna is adapted to work at a NFC frequency of 13.56 MHz.

9. The antenna device of claim 7, wherein a ferromagnetic material sheet to insulate the high frequency coil from the different windings is arranged between the cap and said at least one winding of the at least one magnetic core.

10. The antenna device of claim 7, wherein said electrically insulating base comprises at least one of said metallic tabs per winding end.

* * * * *